US010267009B2

(12) United States Patent
Aurora et al.

(10) Patent No.: US 10,267,009 B2
(45) Date of Patent: Apr. 23, 2019

(54) METHOD OF FORMING A MUDLINE CELLAR FOR OFFSHORE ARCTIC DRILLING

(71) Applicant: CONOCOPHILLIPS COMPANY, Houston, TX (US)

(72) Inventors: Ravi P. Aurora, Sugar Land, TX (US); Mike B. Winfree, Anchorage, AK (US); Jean-Christian M. Haffner, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 14/596,343

(22) Filed: Jan. 14, 2015

(65) Prior Publication Data

US 2015/0197907 A1 Jul. 16, 2015

Related U.S. Application Data

(60) Provisional application No. 61/927,047, filed on Jan. 14, 2014.

(51) Int. Cl.

| | |
|---|---|
| ***E02B 17/00*** | (2006.01) |
| ***E02B 17/02*** | (2006.01) |
| ***E02D 23/08*** | (2006.01) |
| ***E02D 27/52*** | (2006.01) |
| ***E02D 27/22*** | (2006.01) |
| ***E21B 41/00*** | (2006.01) |
| ***E21B 7/12*** | (2006.01) |
| ***E02D 7/28*** | (2006.01) |

(52) U.S. Cl.
CPC ..... *E02D 27/525* (2013.01); *E02D 7/28* (2013.01); *E02D 23/08* (2013.01); *E02D 27/22* (2013.01); *E21B 7/12* (2013.01); *E21B 41/0007* (2013.01)

(58) Field of Classification Search
CPC ..... E02D 27/525; E02D 7/28; E02D 23/08; E21B 33/037; E21B 41/0007
See application file for complete search history.

(56) References Cited

U.S. PATENT DOCUMENTS

| | | | | |
|---|---|---|---|---|
| 1,852,096 A | | 4/1932 | White | |
| 3,063,500 A | * | 11/1962 | Logan | E21B 33/037 166/351 |
| 3,202,217 A | | 8/1965 | Watts et al. | |
| 3,289,421 A | | 12/1966 | Hindman | |

(Continued)

FOREIGN PATENT DOCUMENTS

| | | | | |
|---|---|---|---|---|
| CA | 1248870 A1 | * | 1/1989 | E21B 33/035 |
| DE | 19533281 | | 3/1997 | |
| WO | 2002063106 | | 8/2002 | |

OTHER PUBLICATIONS

International Search Report. PCT/US 15/11414, dated Apr. 7, 2015.

*Primary Examiner* — Benjamin F Fiorello
(74) *Attorney, Agent, or Firm* — Boulware & Valoir

(57) ABSTRACT

A method of forming a mudline cellar includes positioning a mudline cellar forming member on a seafloor surface. The mudline cellar forming member includes an outer surface and an inner surface that defines an inner cavity. The method further includes driving the mudline cellar forming member into the seafloor surface, and excavating the inner cavity of the mudline forming member to establish the mudline cellar.

3 Claims, 4 Drawing Sheets

(56) References Cited

U.S. PATENT DOCUMENTS

| | | | | | |
|---|---|---|---|---|---|
| 3,461,957 | A * | 8/1969 | West | E21B 33/037 | 166/351 |
| 3,592,263 | A * | 7/1971 | Nelson | E21B 33/037 | 166/351 |
| 3,866,676 | A * | 2/1975 | Burns | E21B 33/037 | 166/363 |
| 4,193,455 | A * | 3/1980 | Steddum | E21B 17/01 | 166/359 |
| 4,335,740 | A * | 6/1982 | Boley | E02D 29/12 | 137/364 |
| 4,367,800 | A * | 1/1983 | Arentsen | E02D 7/10 | 173/127 |
| 4,558,744 | A * | 12/1985 | Gibb | E21B 7/185 | 166/222 |
| 5,010,957 | A * | 4/1991 | Kenner | E21B 33/03 | 137/371 |
| 5,145,284 | A * | 9/1992 | Hulett | E02D 5/24 | 405/227 |
| 5,310,286 | A * | 5/1994 | Gilbert | E21B 33/037 | 166/356 |
| 5,951,207 | A * | 9/1999 | Chen | E02D 7/02 | 405/228 |
| 7,527,455 | B2 * | 5/2009 | Raines | B63B 21/27 | 114/296 |
| 8,967,273 | B2 * | 3/2015 | Ray | E21B 47/1025 | 166/337 |
| 2009/0129870 | A1 * | 5/2009 | Jones | E02D 13/04 | 405/228 |
| 2011/0158752 | A1 | 6/2011 | Hitchin | | |
| 2015/0007463 | A1 | 1/2015 | Southerland et al. | | |

* cited by examiner

METHOD OF FORMING A MUDLINE CELLAR FOR OFFSHORE ARCTIC DRILLING

PRIORITY CLAIM

This application is a non-provisional application which claims benefit under 35 USC § 119(e) to U.S. Provisional Application Ser. No. 61/927,047 filed Jan. 14, 2014, entitled "METHOD OF FORMING A MUDLINE CELLAR FOR OFFSHORE ARCTIC DRILLING," which is incorporated herein in its entirety.

FIELD OF THE INVENTION

This invention relates to mudline cellars for arctic drilling and, more specifically, to a method of forming a mudline cellar for offshore arctic drilling.

BACKGROUND OF THE INVENTION

In general, mudline cellars (MLC) are provided in arctic areas where evidence of ice scour is present. A MLC is pit or depression formed in the ocean floor. The MLC may house well head equipment for offshore drilling operations. The MLC shields the well head equipment from contact with drifting ice keels, dragged anchors and the like. In some cases, a MLC may be formed by excavating an area of the ocean floor to form the pit having a bottom and a surrounding wall. In current practice, a MLC may be formed by drilling a hole in the seafloor. The hole exhibits a diameter that is wider than the diameter of a caisson housing the well head equipment. The drilling operation forms the pit having a bottom surface and a surrounding side wall. The caisson is positioned in the pit to prevent the surrounding side wall from collapsing.

SUMMARY OF THE INVENTION

In one embodiment of the present invention, a method of forming a mudline cellar includes positioning a mudline cellar forming member on a seafloor surface. The mudline cellar forming member includes an outer surface and an inner surface that defines an inner cavity. The method further includes driving the mudline cellar forming member into the seafloor surface, and excavating the inner cavity of the mudline cellar forming member to establish the mudline cellar.

In another embodiment of the present invention, a method of installing a mudline cellar in a seafloor includes lowering a mudline cellar forming member having an inner cavity to the seafloor, driving the mudline cellar forming member into the seafloor, and excavating the inner cavity of the mudline cellar forming member to establish the mudline cellar.

BRIEF DESCRIPTION OF THE DRAWINGS

The invention, together with further advantages thereof, may best be understood by reference to the following description taken in conjunction with the accompanying figures by way of example and not by way of limitation, in which.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents.

Figure 1:
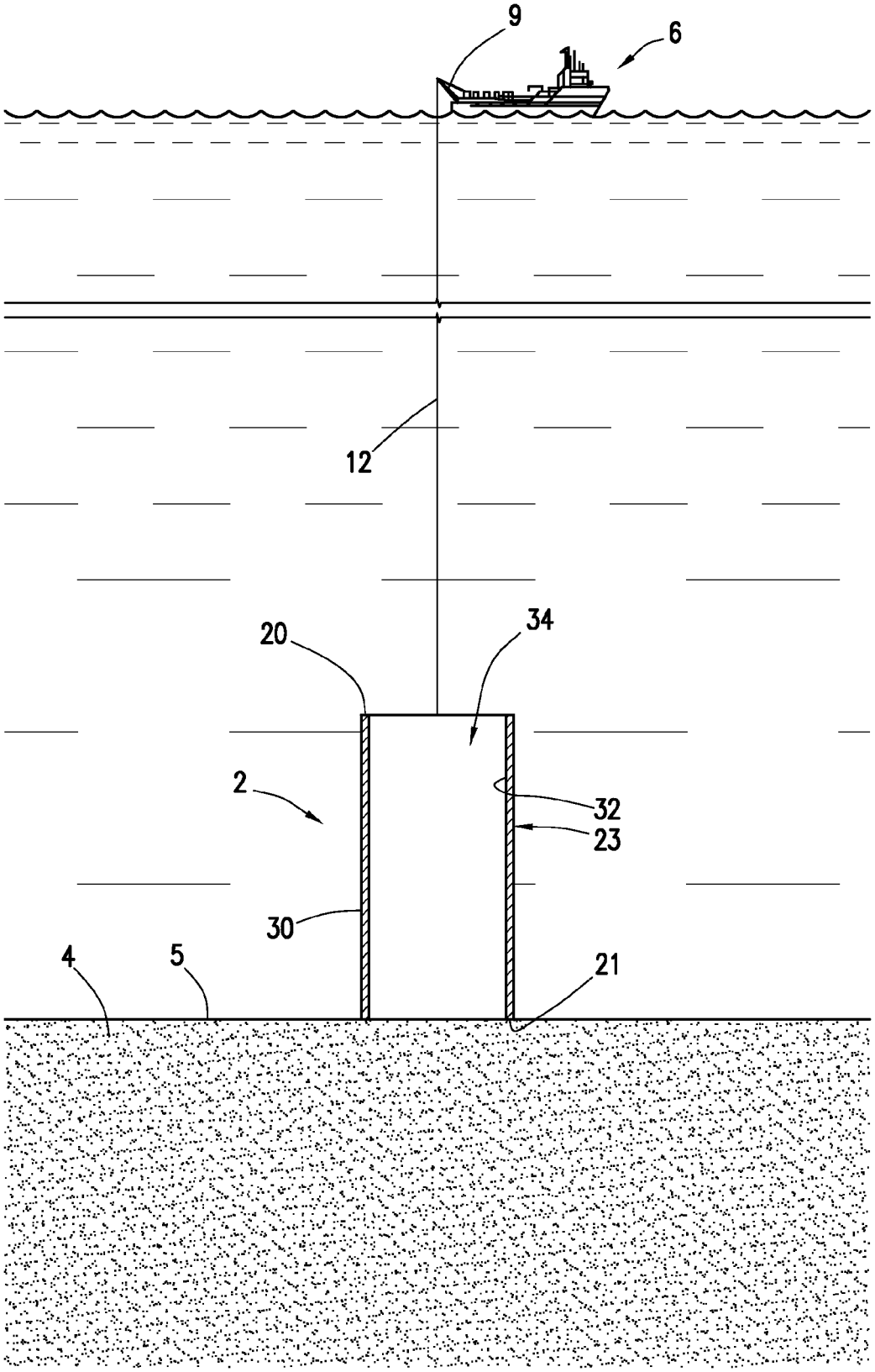
FIG. 1 is an elevational view of a support vessel lowering a mudline cellar (MLC) forming member onto a seafloor surface.

In FIG. 1, a mudline cellar (MLC) forming member 2 is shown being lowered to a seafloor 4 having a seafloor surface 5. A support vessel 6 including a crane 9 lowers MLC forming member 2 toward seafloor surface 5 by a cable or tether 12. In accordance with an exemplary embodiment, MLC forming member 2 extends from a first end 20 to a second end 21 through an intermediate portion 23. Intermediate portion 23 includes a continuous outer surface 30 and a continuous inner surface 32 that defines an uninterrupted inner cavity 34. In accordance with an aspect of the exemplary embodiment, MLC forming member 2 has a cylindrical shape including a cross-sectional diameter of between about 15-feet (4.5-meters) and about 30-feet (9.1-meters). In accordance with another aspect of an exemplary embodiment, MCL forming member 2 includes a cross-sectional diameter of about 20-feet (6.1 meters). Of course, it should be understood that the cross-sectional diameter of MLC forming member 2 may vary. It should also be understood that MLC forming member 2 may be formed in a variety of shapes.

Figure 2:
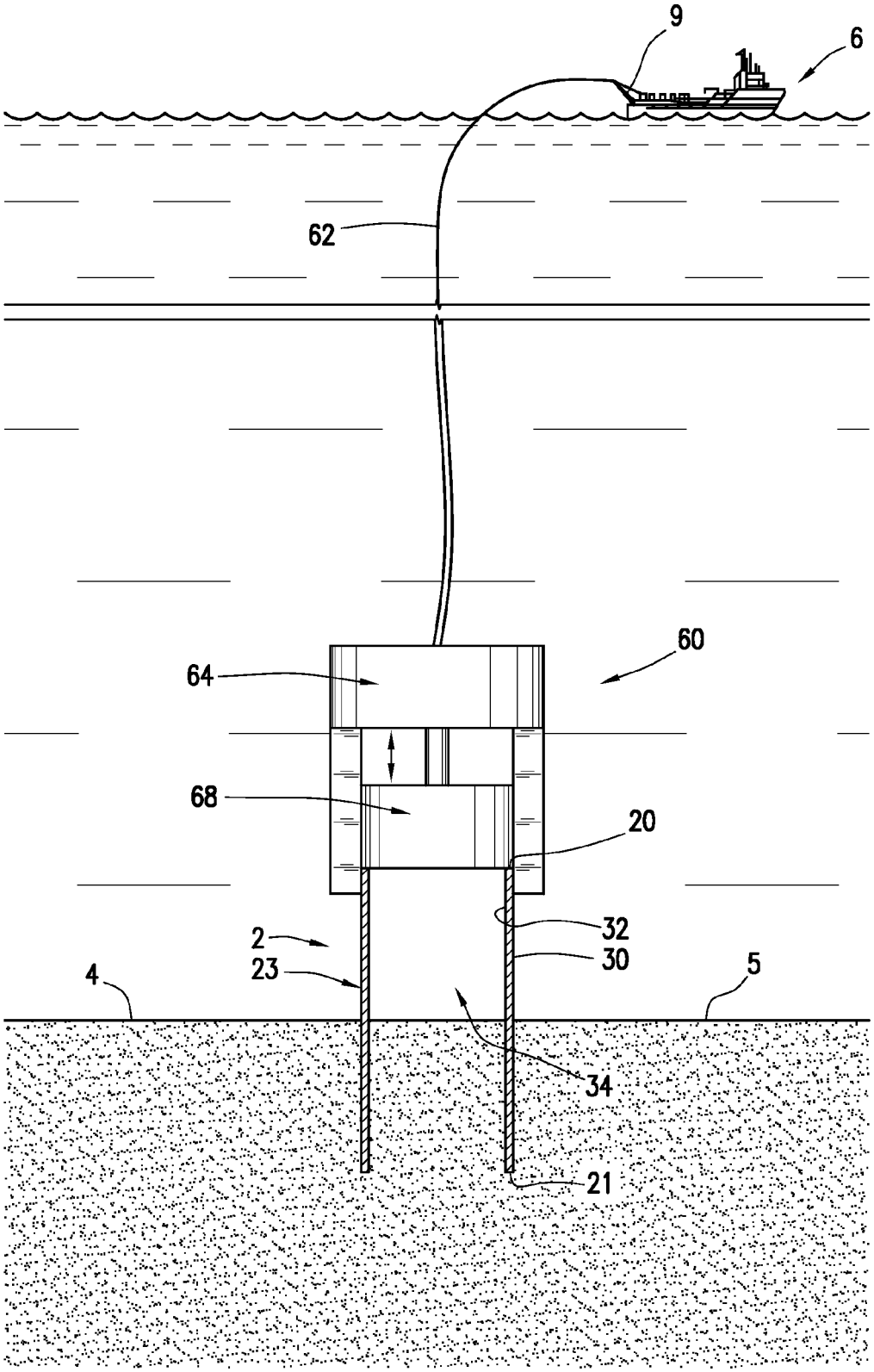
FIG. 2 is a detailed view depicting the MLC forming member being driven into the seafloor surface.

After being deposited/positioned in a desired location upon seafloor surface 5, support vessel 6 lowers a pile driver system 60 onto MLC forming member, as shown in FIG. 2. Pile driver system 60 is tethered to support vessel 6 through a control cable 62 and includes a stationary member 64 and a driving member 68. Stationary member 64 may be arranged at first end 20 of MLC forming member 2. Once in position, driving member 68 repeatedly strikes, or delivers a plurality of impact forces, to first end 20 to embed MLC forming member 2 in seafloor 4. MLC forming member 2 may be installed with little or no disturbance of portions of seafloor 4 adjacent to outer surface 30. More specifically, once installed, little or no gap will exist between outer surface 30 and seafloor 4. As such, portions of seafloor 4 adjacent to MLC forming member 2 remain structurally intact. In this manner, portions of seafloor 4 around MLC forming member 2 provide an uncompromised foundation for supporting spud cans (not shown) and the like.

Figure 3:
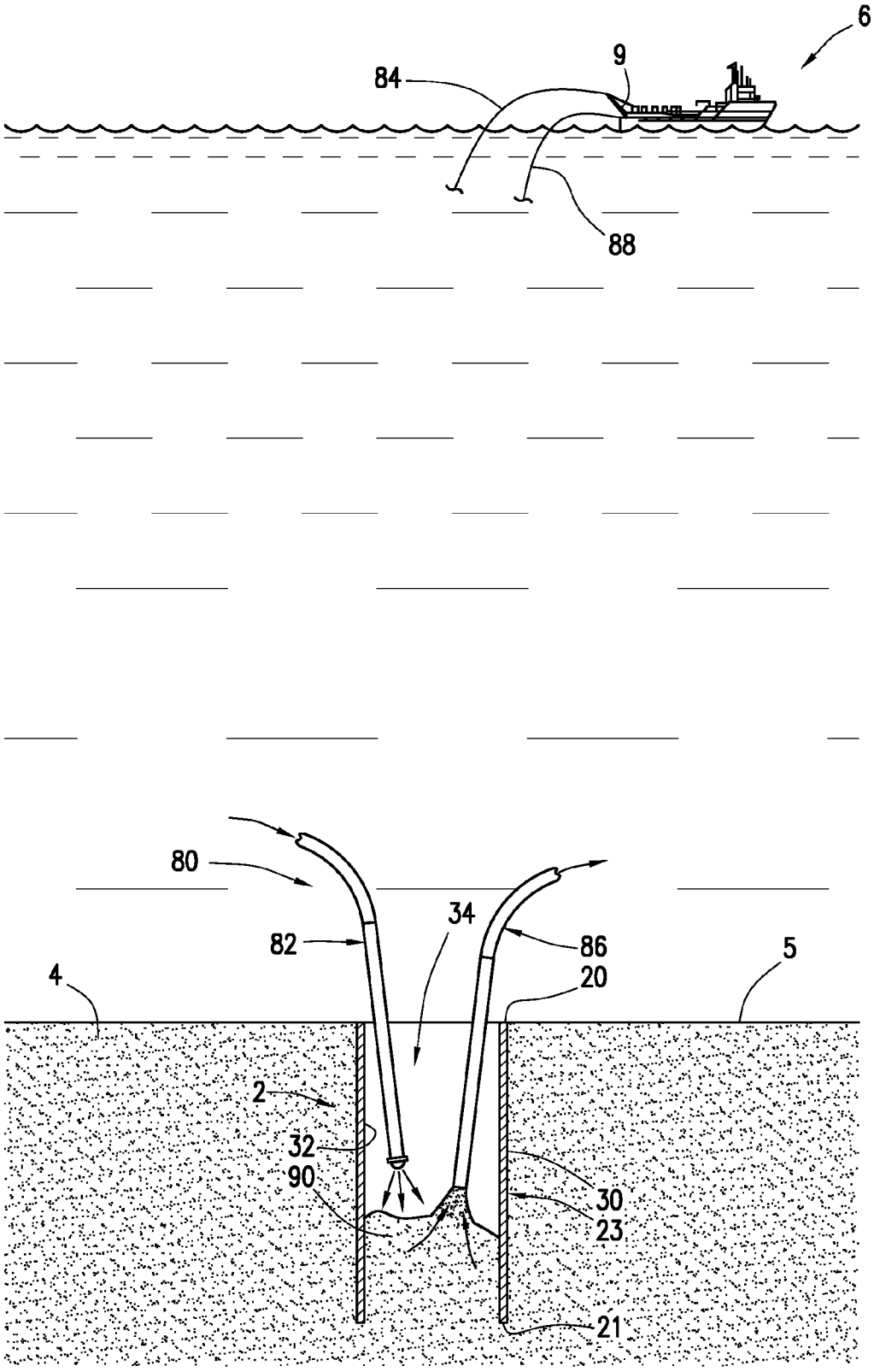
FIG. 3 is a detailed view of an excavating system removing a portion of the seafloor from an inner cavity of the MLC forming member.
Figure 4:
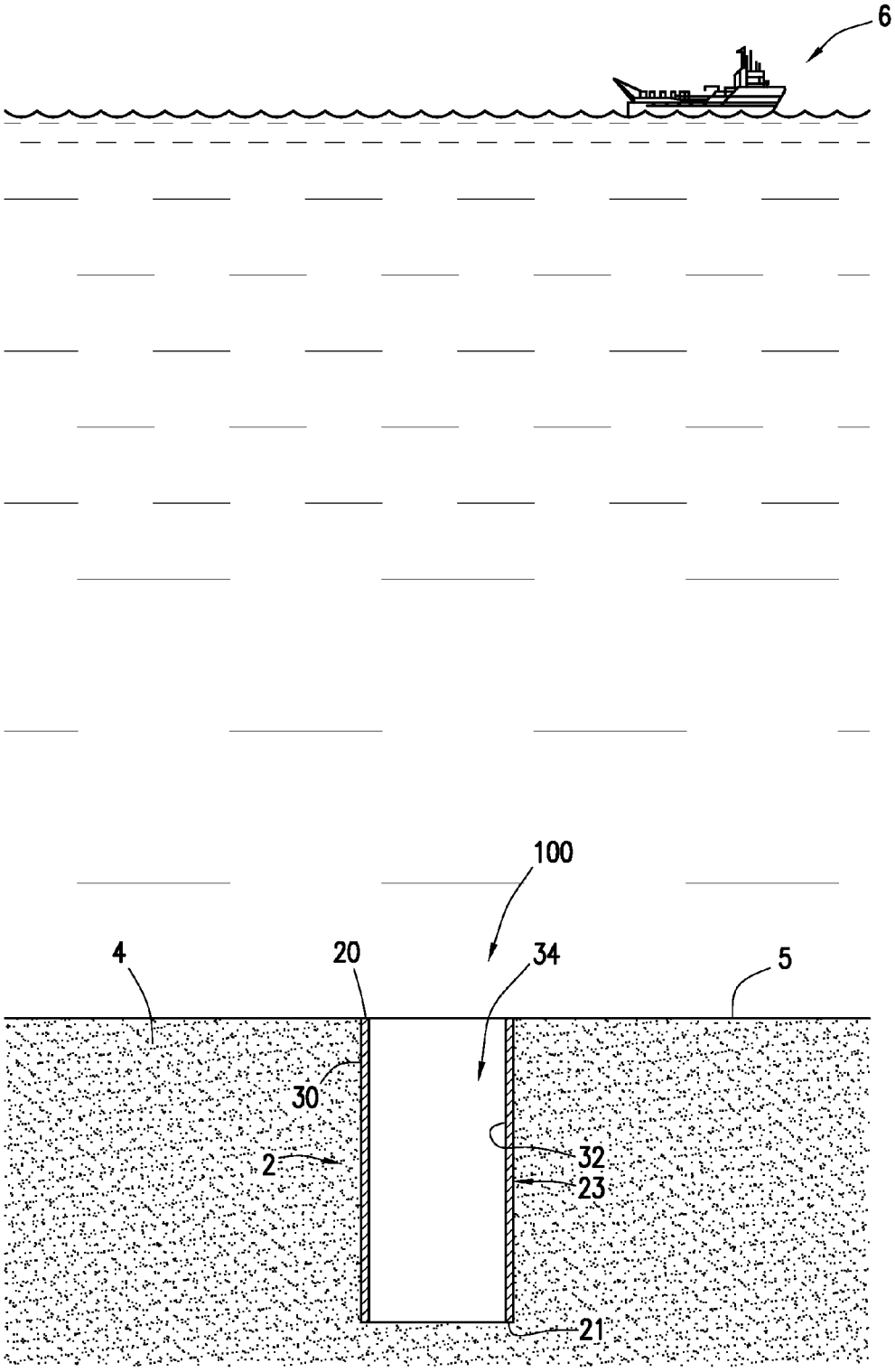
FIG. 4 is a detailed view depicting the MLC forming member embedded in the seafloor to establish a mudline cellar.

Once first end 20 is at, near, or below seafloor surface 5, as shown in FIG. 3, an excavating system 80 is lowered from support vessel 6. Excavating system 80 includes a water jet member 82 operatively connected to support vessel 6 through a first conduit 84, and a vacuum member 86 operatively connected to support vessel 6 through a second conduit 88. Water jet member 82 delivers a jet or pressurized stream of sea water into MLC forming member 2 to break up and dislodge a portion of seafloor 90 within inner cavity 34. Vacuum member 86 collects the portion of seafloor 90. The portion of seafloor 90 is delivered to an area away from inner cavity 34. Excavation continues until portion of seafloor 90 is removed and inner cavity 34 is devoid of seafloor thereby forming a mudline cellar 100. Mudline cellar 100 may receive and protect drilling equipment such as well head equipment from ice keels, anchors or other obstacles that may exist at a drilling site. In this manner, well head equipment may remain on site and protected both during and after drilling operations.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method of forming a mudline cellar comprising:

positioning a mudline cellar forming member on a seafloor surface, the mudline cellar forming member having a cylindrical cross section and including a first open end and a second open end opposite said first end and a continuous outer surface and a continuous inner surface between said first end and said second end that defines an uninterrupted inner cavity;

driving the mudline cellar forming member into the seafloor surface with a pile driver system using a plurality of impact forces on said first end of the mudline cellar forming member;

lowering a water jet and a vacuum to said inner cavity; and delivering a pressurized stream of sea water via said water jet into said inner cavity to break up a portion of seafloor and vacuuming said portion of seafloor via said vacuum, thereby excavating the inner cavity of the mudline cellar forming member from said first end to said second end to establish a mudline cellar, wherein the entire excavated inner cavity is devoid of seafloor, and wherein there is substantially no change in structural integrity of the seafloor surface outside of the mudline cellar.

2. The method of claim 1, wherein said cylindrical mudline cellar forming member has a cross-sectional diameter of between about 15-feet (4.5-meters) and about 30-feet (9.1-meters).

3. The method of claim 1, wherein driving the mudline cellar forming member into the seafloor surface includes forcing the mudline cellar forming member into the seafloor surface such that substantially no gap is present between the outer surface of the mudline cellar forming member and the seafloor surface.

* * * * *